US011766713B2

(12) United States Patent
Zhan et al.

(10) Patent No.: US 11,766,713 B2
(45) Date of Patent: Sep. 26, 2023

(54) METHOD TO FORM AXISYMMETRIC MAGNESIUM ARTICLE BY FORGING AND FLOW-FORMING PROCESS

(71) Applicant: GM Global Technology Operations LLC, Detroit, MI (US)

(72) Inventors: Henry Zhan, Yueyang (CN); Congjie Wang, Shanghai (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 16 days.

(21) Appl. No.: 17/481,641

(22) Filed: Sep. 22, 2021

(65) Prior Publication Data

US 2023/0050499 A1 Feb. 16, 2023

(30) Foreign Application Priority Data

Aug. 13, 2021 (CN) ..... 202110932302.2

(51) Int. Cl.

| | |
|---|---|
| ***B21K 1/34*** | (2006.01) |
| ***B21K 1/40*** | (2006.01) |
| ***C22F 1/00*** | (2006.01) |
| ***B21J 5/00*** | (2006.01) |
| ***C22F 1/06*** | (2006.01) |
| ***B21J 1/00*** | (2006.01) |

(52) U.S. Cl.

CPC ..... *B21K 1/34* (2013.01); *B21J 1/003* (2013.01); *B21J 5/002* (2013.01); *B21K 1/40* (2013.01); *C22F 1/002* (2013.01); *C22F 1/06* (2013.01)

(58) Field of Classification Search

CPC .. B21J 1/003; B21J 5/002; B21K 1/34; B21K 1/40; C22F 1/002; C22F 1/06

See application file for complete search history.

(56) References Cited

U.S. PATENT DOCUMENTS

2020/0354818 A1* 11/2020 Sherman ..... C22F 1/06

FOREIGN PATENT DOCUMENTS

| | | |
|---|---|---|
| CN | 107338379 A | 11/2017 |
| CN | 114686710 A | 7/2022 |
| CN | 114908278 A | 8/2022 |

* cited by examiner

*Primary Examiner* — Moshe Wilensky

(74) *Attorney, Agent, or Firm* — Vivacqua Crane PLLC

(57) ABSTRACT

A method to form a magnesium article includes: heating materials including magnesium, aluminum, manganese and tin in a furnace to create an alloy having a composition of; the magnesium in an amount greater than or equal to 90% by weight of the materials; the aluminum ranging between approximately 2.0% up to approximately 4.0% by weight of the materials; the manganese ranging between approximately 0.43% up to approximately 0.6% by weight of the materials; and the tin ranging between approximately 1% up to approximately 3% by weight of the materials; chill casting the alloy to create a cast billet; and heating the cast billet at a temperature ranging from approximately 380° C. up to approximately 420° C. and maintaining the temperature for a time period between approximately 4 hours to 10 hours to homogenize element distribution.

16 Claims, 5 Drawing Sheets

64

| ELEMENTS (wt.%) | Al | Mn | Zn | Sn | Mg |
|---|---|---|---|---|---|
| | 2-4% | 0.3 TO 0.4% | 0-3% | 0 TO 1% | >90% |

METHOD TO FORM AXISYMMETRIC MAGNESIUM ARTICLE BY FORGING AND FLOW-FORMING PROCESS

INTRODUCTION

The present disclosure relates to forged and flow-formed articles including automobile vehicle wheels.

Current processes for forming automobile vehicle alloy wheels include casting an ingot of a metal including magnesium, extruding a magnesium billet, forging a blank from the extruded billet, flow-forming and pre-machining the blank and performing final machining operations such as for example to finish a hub diameter, wheel spokes and lug bores. Aluminum material is also commonly used for automobile vehicle wheels as its intrinsic formability in a flow forming process is excellent without requiring pre-extrusion.

Magnesium alloy materials such as ZK30 comprising a magnesium-zinc-zirconium alloy have also been adapted for this use and provide excellent formability but have a high cost due to addition of zirconium (Zr) material to improve formability in flow forming. ZK30 is therefore presently limited to niche market applications. Known zirconium-free material such as AZ80 comprising a magnesium-aluminum-zinc alloy is inexpensive compared to ZK30 alloy but suffers from insufficient formability and cracking during flow-forming following forging. Low formability precludes use of AZ80 alloy in mass production processes for automobile vehicle wheel applications.

Thus, while current aluminum and magnesium-zinc-zirconium alloy materials achieve their intended purpose, there is a need for a new and improved system and method for forming an axisymmetric article such as an automobile vehicle wheel.

SUMMARY

According to several aspects, a method to form a magnesium article includes: heating materials including magnesium, aluminum, manganese and tin in a furnace to create an alloy having a composition of; the magnesium in an amount greater than or equal to 90% by weight of the materials; the aluminum ranging between approximately 2.0% up to approximately 4.0% by weight of the materials; the manganese ranging between approximately 0.43% up to approximately 0.6% by weight of the materials; and the tin ranging between approximately 1% up to approximately 3% by weight of the materials; chill casting the alloy to create a cast billet; and heating the cast billet at a temperature ranging from approximately 380° C. up to approximately 420° C. and maintaining the temperature for a time period between approximately 4 hours to 10 hours to homogenize element distribution.

In another aspect of the present disclosure, the method further includes forging the cast billet in a single-step or multiple-step forging operation to create a forged blank; and flow-forming the forged blank to form a final shape defining a pre-machined blank.

In another aspect of the present disclosure, the method further includes maintaining a forging temperature ranging from approximately 350° C. up to approximately 450° C. when forging the cast billet.

In another aspect of the present disclosure, the method further includes extruding the cast billet at a temperature ranging from approximately 300° C. up to approximately 450° C. with an extrusion ratio ranging from approximately 2 up to approximately 10 to improve formability of the cast billet.

In another aspect of the present disclosure, the method further includes maintaining a forging temperature ranging from approximately 350° C. up to approximately 450° C. when forging the extruded billet.

In another aspect of the present disclosure, the method further includes heating the forged blank to a temperature ranging between approximately 300° C. to 420° C. prior to flow-forming.

In another aspect of the present disclosure, the method further includes quenching after flow-forming the heated forged blank from a working temperature ranging from approximately 0 C to 100° C.

In another aspect of the present disclosure, the method further includes ageing after flow-forming the heated forged blank at a temperature ranging from approximately 150° C. to 200° C. for 2 to 20 hours.

In another aspect of the present disclosure, the method further includes finish machining the pre-machined blank to create a desired object such as an axisymmetric magnesium article.

In another aspect of the present disclosure, the method further includes when forging the cast billet forging a hub and multiple spokes defining a forged blank having a circumferential rim.

According to several aspects, a method to form an axisymmetric magnesium article by forging and flow forming includes: smelting multiple materials including magnesium (Mg), aluminum (Al), manganese (Mn) and tin (Sn) in a casting process; solidifying the multiple materials from the casting process into a cast ingot; performing a heat treatment process on the cast ingot at a temperature of approximately 400° C. for a time period of approximately 5 hours to induce precipitation of nanoparticles of Al/Mn out of a matrix of the magnesium; forging the cast ingot after the heat treatment process to form a forged blank; and flow forming the forged blank into a pre-machined blank.

In another aspect of the present disclosure, the method further includes dissolving the Sn into the Mg matrix by conducting the flow forming at a temperature ranging from approximately 300° C. up to approximately 420° C.

In another aspect of the present disclosure, the method further includes supersaturating portions of the Sn into the matrix of the Magnesium by quenching after the flow forming.

In another aspect of the present disclosure, the method further includes ageing the flow formed blank at 150° C. to 200° C. for 2 to 20 hours after the quenching to precipitate Mg/Mn particles to enhance strength.

In another aspect of the present disclosure, the method further includes adding zinc (Zn) into the melt in an amount less than 3% by weight.

In another aspect of the present disclosure, the method further includes adding the materials in the following amounts by weight of the materials: the magnesium being greater than or equal to 90% by weight of the materials; the aluminum ranging between approximately 2.0% up to approximately 4.0% by weight of the materials; and the manganese ranging between approximately 0.43% up to approximately 0.6% by weight of the materials.

According to several aspects, an automobile vehicle axisymmetric magnesium article, comprising: multiple materials including magnesium (Mg), aluminum (Al); manganese (Mn), and tin (Sn); the magnesium being present at greater than or equal to 90% by weight of the materials; the aluminum ranging between approximately 2.0% up to approximately 4.0% by weight of the materials; the manganese ranging between approximately 0.43% up to approximately 0.6% by weight of the materials; the tin ranging between approximately 1.0% up to approximately 3.0% by weight of the materials; and a plurality of nanoparticles of Al/Mn precipitated out of a matrix of the magnesium, the plurality of nanoparticles refining a plurality of dynamic recrystallized grains and inhibiting the growth of the dynamic recrystallized grains.

In another aspect of the present disclosure, a rim is flow-formed after pre-heating to a temperature ranging between approximately 300° C. to 420° C.

In another aspect of the present disclosure, an automobile vehicle wheel includes the circumferential rim machined from the pre-machined blank.

In another aspect of the present disclosure, an average equivalent diameter of DRX grains in the circumferential rim after roll forming is more than 10% smaller than in an outboard flange of the automobile vehicle wheel, and an average equivalent diameter of the dynamic recrystallized grains in the circumferential rim being less than 10 um.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
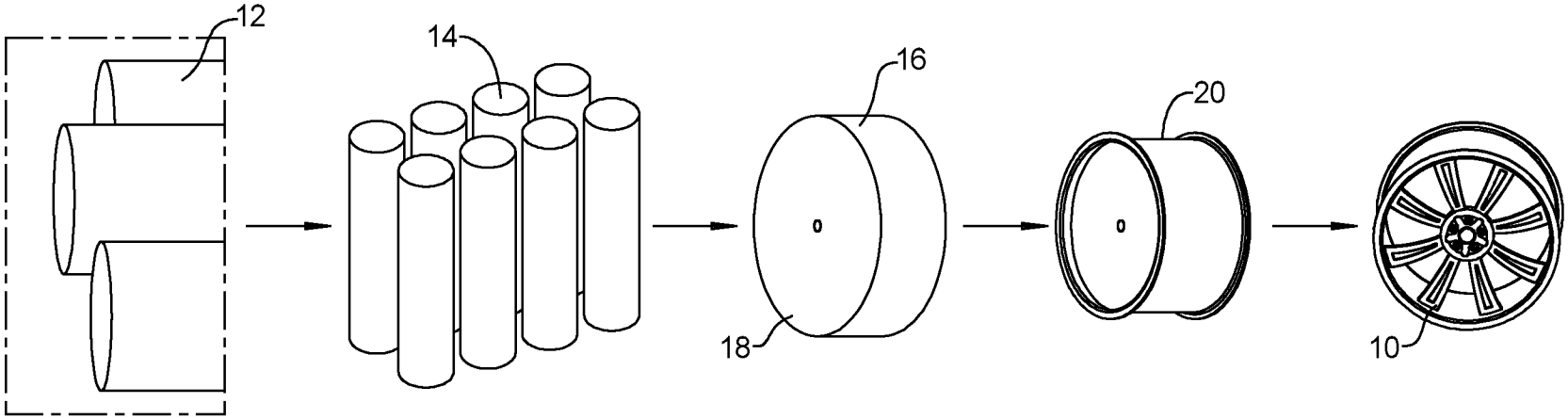
FIG. 1 is a diagram of multiple stages of formation of an axisymmetric article according to an exemplary aspect.

Referring to FIG. 1, an axisymmetric magnesium article 10 of the present disclosure is formed in several article stages including a first article stage defining a cast ingot 12 formed by directed chill casting of a Mg—Al—Mn—Sn material alloy. A second article stage defining a cast billet 14 follows heat treatment of the cast ingot 12 to create a smooth formation of Al—Mn nanoparticles of the Mg—Al—Mn—Sn material alloy and homogenized elemental distribution. A third article stage defines a forged blank 16 created from the cast billet 14 in a forging station in a single step or a multiple-step forging operation. The forged blank 16 includes a hub and spokes and a circumferential rim 18. The circumferential rim 18 has a larger thickness and a shorter width than a shape of a rim of a desired integral wheel structure. A fourth article stage defines a pre-machined blank 20 from flow-forming the forged blank 16. The axisymmetric magnesium article 10 defines a fifth article stage creating a finished and machined item such as an automobile vehicle integral wheel structure from the pre-machined blank 20 and having a final rim shape and after finish machining.

Referring to FIG. 2 and again to FIG. 1, a method 22 to form the axisymmetric magnesium article 10 of FIG. 1 by forging and flow forming includes a first procedure 24 including smelting raw magnesium-aluminum-manganese-tin materials in a furnace with a composition described below in reference to FIG. 5. In a second procedure 26, the smelted material from the first procedure 24 is chill casted to create the cast billet 14 described in reference to FIG. 1. In a third procedure 28, the cast billet 14 is then heated at a temperature ranging from approximately 380° C. up to approximately 420° C. and maintained at this temperature for a time period between approximately 4 hours to 10 hours prior to forging the cast billet 14 to obtain smooth formation of the Al—Mn nanoparticles of the Mg—Al—Mn—Sn material alloy and to homogenize elemental distribution.

The cast billet 14 is then transferred, for example by a robot, to a forging station where in a fourth procedure 30, the pre-heated cast billet 14 is subjected to single-step or a multiple-step of forging operation at a forging temperature that may range from approximately 350° C. up to approximately 450° C. The forging operation forms a hub and spokes defining the forged blank 16 having the circumferential rim 18 described in reference to FIG. 1. In a fifth procedure 32 the forged blank 16 is then pre-heated as necessary to a temperature ranging between approximately 300° C. to 420° C. and subjected to flow-forming to form a final shape defining the pre-machined blank 20 which may then be quenched from working temperature to approximately 0 C to 100° C. followed by ageing treatment at a temperature of approximately 150° C. to 200° C. for 2 to 20 hours. The pre-machined blank 20 is then finish machined to form the desired object such as the axisymmetric magnesium article 10.

Figure 3:
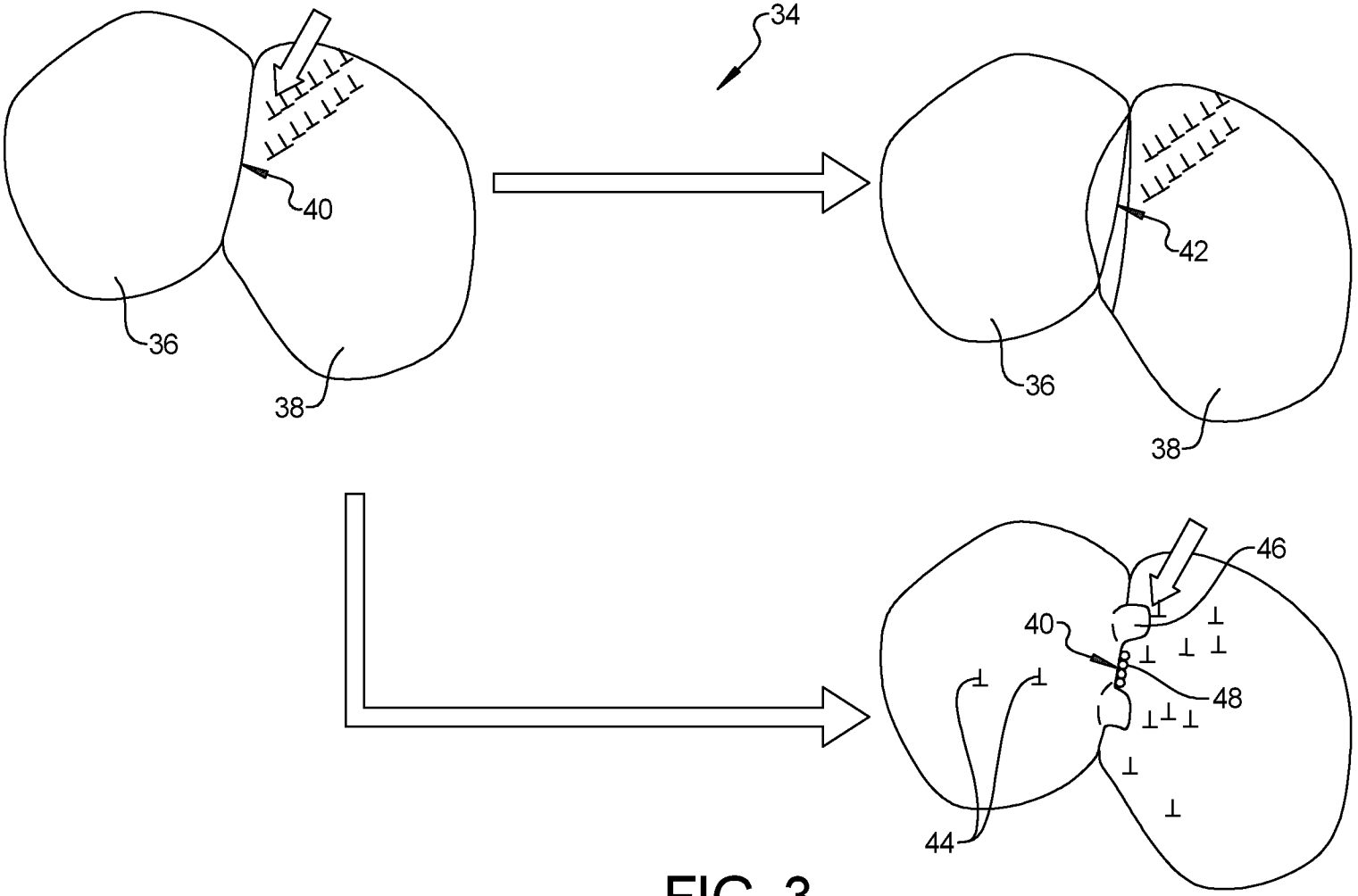
FIG. 3 is a diagram of an intergranular boundary between exemplary grains of the alloy of the present disclosure.

Referring to FIG. 3, a material diagram 34 identifies an intrinsic property of Magnesium is a deformation incompatibility between a hard orientation grain 36 and a soft orientation grain 38 at an intergranular boundary 40. In deformation, plastic strain will be concentrated in soft orientation grain 38. Dislocation 44, as a crystal lattice defect which carries deformation strain, will be generated and piled up at the intergranular boundary 40. In a hot deformation process employing low strain rate, such as forging, grain boundary bulging of the hard orientation grain 36 onto or into the soft orientation grain 38 wipes out dislocation 44 piling up at the intergranular boundary 40 to heal the incompatibility of adjacent material grains, which reduces a likelihood of cracking at the intergranular boundary 40. However, in a hot deformation process employing high strain rate, such as flow-forming, grain boundary movement may be suppressed, leading to the absence of grain boundary bulging. If no grain boundary bulge is present, this incompatibility may lead to intergranular cracking 42, which has been identified in the flow-forming process when aluminum content in the alloy is above a predefined maximum content.

With continuing reference to FIG. 3, microstructural features affecting grain boundary bulging include: solute and precipitated particles. According to several aspects, a mobility of the grain boundary is markedly impeded by drag effect from Al solutes of a Magnesium matrix when Al content in the alloy is increased above 4%; and a pinning effect from dynamic precipitated particles including $Mg_{17}Al_{12}$ particles at the intergranular boundary 40 may also impede movement of the intergranular boundary 40. Therefore, Al content in the alloy needs to be tailored to avoid strong drag effect of Al solute and precipitation of $Mg_{17}Al_{12}$ particles.

The addition of Al is provided for castability and strength. According to several aspects, Al content ranges from 2.0% to 4.0% for a balance between intergranular boundary mobility and castability.

Tin (Sn) solute has weak drag effect on boundary mobility. Therefore, a certain amount of Sn is added to improve castability and strength for the alloy to make up for the reducing Al content. In the flow forming process conducted at temperatures ranging from approximately 300° C. to 452° C., Sn can be dissolved in the Mg matrix. By quenching, Sn can be supersaturated in the Mg matrix. In the following ageing treatment conducted at 150° C. to 200° C. for 2 to 20 hours Mg—Sn particles will precipitate out to enhance strength. To avoid a significant cost increment, Sn addition is controlled to range from 1% to 3%.

Similar to Sn, Zinc (Zn) solute has weak drag effect on boundary mobility. In addition, Zn addition is beneficial for fluidity of the melt in casting when its amount is equal to or less than 3%. Zn addition will also enhance strength properties in the final product owing to a solid solution strengthening effect.

Though calcium and rare earth elements may help modify texture of microstructure and improve formability, calcium and rare earth elements tend to segregate to grain boundaries and have strong drag effect on boundary movement. Therefore, the alloy of the present disclosure is substantially free of calcium and rare earth elements, <0.05%.

Figures 2, 5:
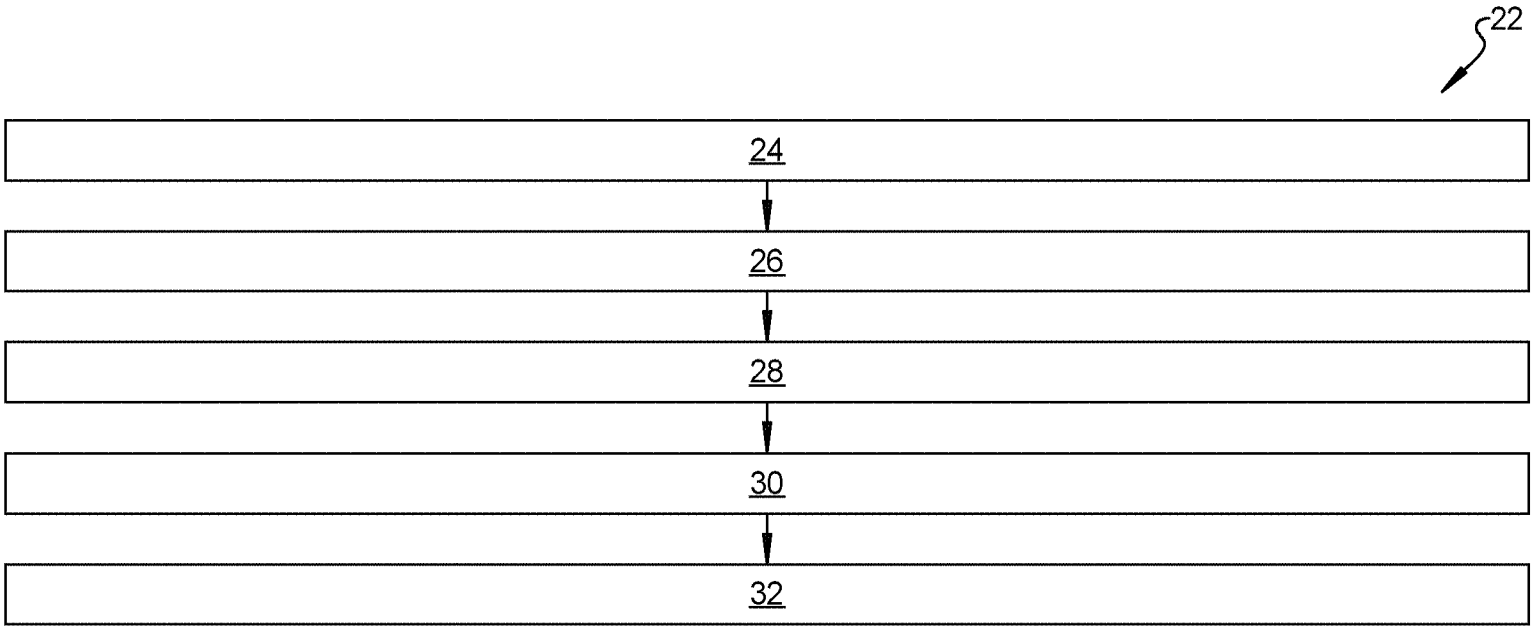
FIG. 2 is a flow diagram of the method steps to create the article of FIG. 1.
FIG. 5 is a table of materials and material percentages by weight for the article of FIG. 1.

Referring to FIG. 4 and again to FIGS. 1 and 2, the method 22 to form the axisymmetric magnesium article 10 of FIG. 1 further includes the following processes. After heat treatment the forged blank 16 is transferred for example using a robot 50 to a roll forming station 52. During roll forming the circumferential rim 18 is positioned onto a mandrel 54. A roller 56 is displaced in a pressing direction 58 to apply pressure to the circumferential rim 18 and is further displaced in a forming direction 60 to roll-form the circumferential rim 18 to a completed form including an outboard flange 62 of the pre-machined blank 20. In the process of the present disclosure, only the rim portion is deformed. For other portions such as the hub and the outboard flange, staying at elevated temperature may lead to coarsening of microstructure which leads to degradation of mechanical properties. Therefore, thermal stability of the microstructure in the forged blank 16 is enhanced to avoid undesirable coarsening in the microstructure.

The alloy of the present disclosure produces a high volume of Al—Mn nanoparticles 74 during heat treatment 72 following casting 66 to improve thermal stability for the new Mg—Al alloy. The Al—Mn nanoparticles 74 help refine dynamic recrystallized grains in the forging process 76 and inhibit their growth, which further contributes to intergranular boundary strengthening. Manganese (Mn) is conventionally added in commodity AZ80 and AZ31 alloys for neutralizing negative effect of iron (Fe) brought to corrosion resistance. In the alloy of the present disclosure, Mn is added to generate a high volume of Al—Mn nanoparticles to enhance thermal stability of microstructure in the forged blank. The volume of Al—Mn nanoparticles 74 are larger than comparable particles formed in AZ80 with a preference for low Aluminum and high Manganese. Microalloying of manganese in the casting process is difficult due to limited solubility of manganese in magnesium. Therefore, manganese content in the present alloy is limited to 0.6% considering processability in scale-up production. Adding manganese at higher than 0.6% content may lead to undissolved coarse Mn-containing intermetallic particles 70 in as-cast microstructure which is detrimental for the following forming process and the ductility in the final product.

Referring to FIG. 5 and again to FIGS. 1 and 2, a table 64 provides exemplary ranges for the amounts of materials by weight present in the alloy of the present disclosure. As shown in table 64 magnesium is present in amounts from approximately 90% and greater by weight. According to several aspects, aluminum may be present from approximately 2.0% to 4.0% by weight. According to further aspects, aluminum is present from approximately 2.5% to 3.0% by weight. According to several aspects, manganese may be present from approximately 0.43% to 0.6% by weight. According to further aspects, manganese is present from approximately 0.45% to 0.55% by weight. According to several aspects, tin may be present from approximately 1.0% to 3.0% by weight. According to further aspects, tin is present from approximately 1.5% to 2.5% by weight. According to several aspects, zinc may be present from approximately 0% to 3.0% by weight. According to further aspects, zinc is present from approximately 0.5% to ⅓% by weight.

Referring to FIG. 6 and again to FIGS. 1 through 5, to maintain good mechanical properties in the pre-machined blank 20, fine-grained microstructure in the forged blank 16 needs to have good thermal stability. From FIG. 5, a "lean" aluminum content of less than 4% by weight of aluminum is selected for excellent flow formability of the Mg—Al alloy. During a casting stage 66 defined above as the second procedure 26, a Magnesium (Mg) matrix 68 supersaturated in Manganese containing intermetallics 70 is formed. The supersaturation of Manganese in a Magnesium dendrite occurs after solidification of the casting. During a homogenization stage 72 occurring when the casting is subsequently heated in the third procedure 28 described above, an Al—Mn dispersoid 74 precipitates among the Manganese (Mn) containing intermetallics 70. In a forging stage 76 during the fourth procedure 30 described above, the Al—Mn dispersoid 74 together with the Mn containing intermetallics 70 act to refine dynamic recrystallized (DRX) grains 78 and thereby inhibit the growth of the recrystallized grains.

Figure 4:
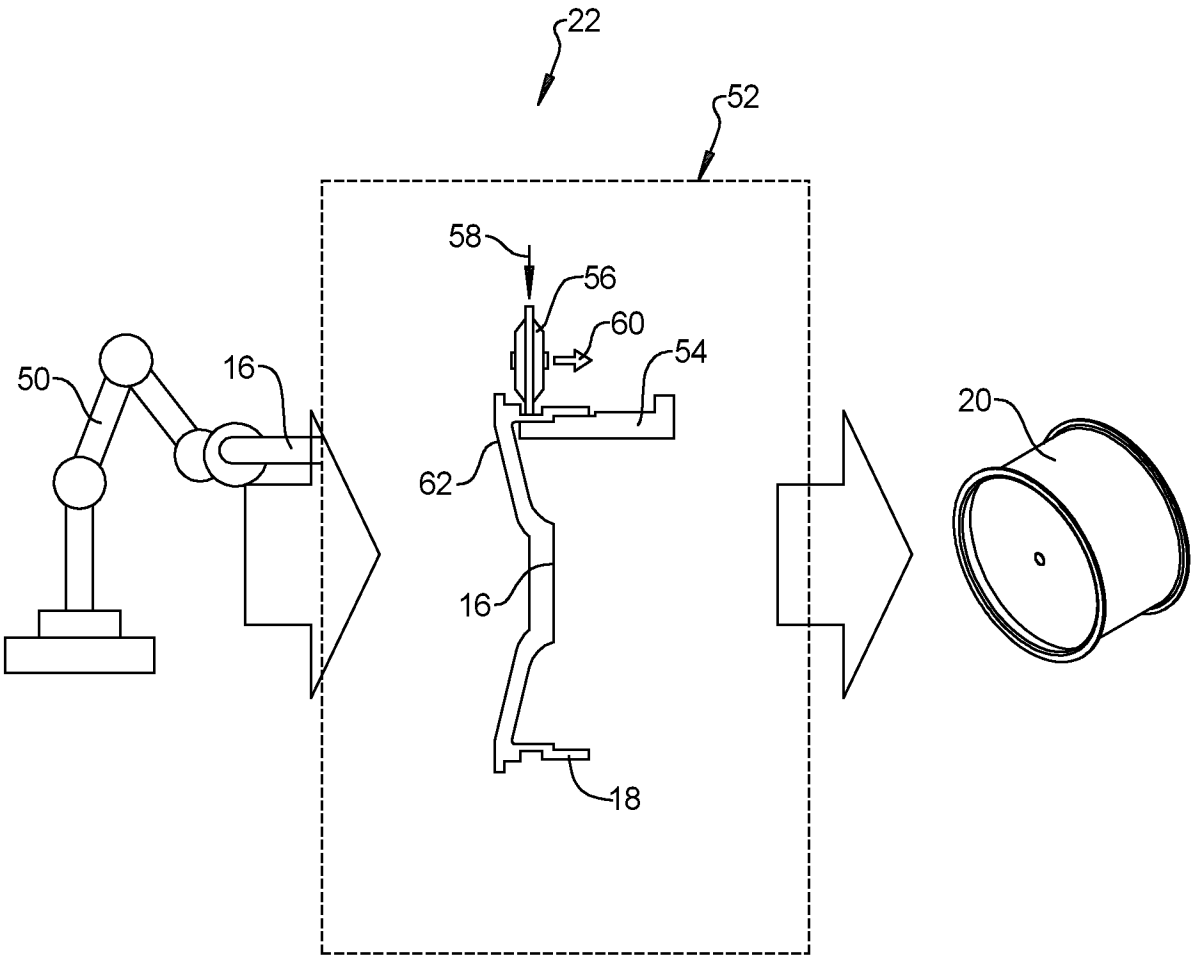
FIG. 4 is a diagram of a flow forming step during formation of the axisymmetric article of FIG. 1.
Figure 6:
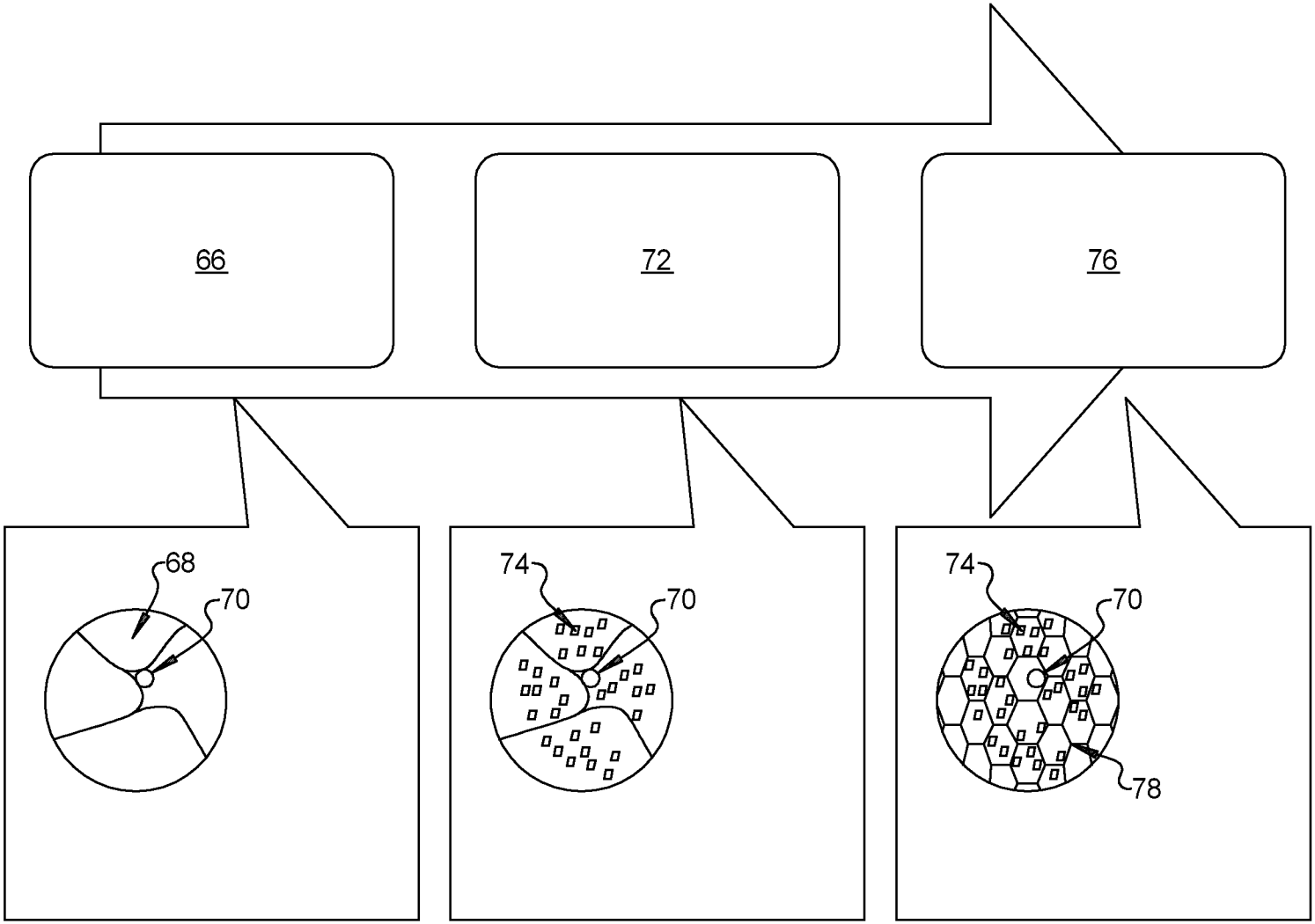
FIG. 6 is a diagrammatic presentation of microstructural evolution for an alloy during stages of formation of the present disclosure.

With continuing reference to FIGS. 1, 4 and 6, an average equivalent diameter of DRX grains in the circumferential rim 18 after roll forming is more than 10% smaller than that in the outboard flange 62. An average equivalent diameter of DRX grains in the circumferential rim 18 is less than 10 um.

A method to form an axisymmetric magnesium article 10 of the present disclosure offers several advantages. These include provision of a magnesium-aluminum alloy chemistry based on a zirconium-free alloy system (Mg—Al—Mn—Sn) that may be flow-formed, a microstructure suitable for flow-forming, and a manufacturing process for producing axisymmetric magnesium components such as automobile vehicle wheels.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A method to form a magnesium article, comprising:

heating materials including magnesium, aluminum, manganese and tin in a furnace to create an alloy having a composition of:

the magnesium in an amount greater than or equal to 90% by weight of the materials;

the aluminum ranging between approximately 2.0% up to approximately 4.0% by weight of the materials;

the manganese ranging between approximately 0.43% up to approximately 0.6% by weight of the materials; and the tin ranging between approximately 1% up to approximately 3% by weight of the materials;

chill casting the alloy to create a cast billet; and heating the cast billet at a temperature ranging from 380 C up to 420 C and maintaining the temperature for a time period between 4 hours to 10 hours to homogenize element distribution.

2. The method of claim 1, further including:

forging the cast billet in a single-step or multiple-step forging operation to create a forged blank; and flow-forming the forged blank to form a final shape defining a pre-machined blank.

3. The method of claim 2, further including maintaining a forging temperature ranging from approximately 350 C up to approximately 450 C when forging the cast billet.

4. The method of claim 1, further including extruding the cast billet at a temperature ranging from approximately 300 C up to approximately 450 C with an extrusion ratio ranging from approximately 2 up to approximately 10 to improve formability of the cast billet.

5. The method of claim 4, further including maintaining a forging temperature ranging from approximately 350 C up to approximately 450 C when forging the extruded billet.

6. The method of claim 2, further including heating the forged blank to a temperature ranging between approximately 300 C to 420 C prior to flow-forming.

7. The method of claim 6, further including quenching after flow-forming the heated forged blank from a working temperature ranging from approximately 0 C to 100 C.

8. The method of claim 7, further including ageing after flow-forming the heated forged blank at a temperature ranging from approximately 150 C to 200 C for 2 to 20 hours.

9. The method of claim 2, further including finish machining the pre-machined blank to create a desired object such as an axisymmetric magnesium article.

10. The method of claim 2, wherein when forging the cast billet forging a hub and multiple spokes defining a forged blank having a circumferential rim.

11. A method to form an axisymmetric magnesium article by forging and flow forming, comprising:

smelting multiple materials including magnesium (Mg), aluminum (Al), manganese (Mn) and tin (Sn) in a casting process;

solidifying the multiple materials from the casting process into a cast ingot;

performing a heat treatment process on the cast ingot at a temperature of 400 C for a time period of 5 hours to induce precipitation of nanoparticles of Al/Mn out of a matrix of the magnesium;

forging the cast ingot after the heat treatment process to form a forged blank; and flow forming the forged blank into a pre-machined blank.

12. The method of claim 11, further including dissolving the Sn into the Mg matrix by conducting the flow forming at a temperature ranging from approximately 300 C up to approximately 420 C.

13. The method of claim 12, further including supersaturating portions of the Sn into the matrix of the Magnesium by quenching after the flow forming.

14. The method of claim 12, further including ageing the flow formed blank at 150 C to 200 C for 2 to 20 hours after the quenching to precipitate Mg/Mn particles to enhance strength.

15. The method of claim 11, further including adding zinc (Zn) into the melt in an amount less than 3% by weight.

16. The method of claim 11, further including adding the materials in the following amounts by weight of the materials:

the magnesium being greater than or equal to 90% by weight of the materials;

the aluminum ranging between approximately 2.0% up to approximately 4.0% by weight of the materials; and the manganese ranging between approximately 0.43% up to approximately 0.6% by weight of the materials.

* * * * *